US012692107B2

(12) United States Patent
Shimosaka et al.

(10) Patent No.: US 12,692,107 B2
(45) Date of Patent: Jul. 28, 2026

(54) MEDIUM CONVEYING APPARATUS

(71) Applicant: PFU LIMITED, Kahoku (JP)

(72) Inventors: Kiichiro Shimosaka, Kahoku (JP); Syuichi Morikawa, Kahoku (JP)

(73) Assignee: PFU LIMITED, Kahoku (JP)

( * ) Notice: Subject to any disclaimer, the term of this patent is extended or adjusted under 35 U.S.C. 154(b) by 27 days.

(21) Appl. No.: 18/412,213

(22) Filed: Jan. 12, 2024

(65) Prior Publication Data

US 2024/0150141 A1 May 9, 2024

Related U.S. Application Data

(63) Continuation of application No. PCT/JP2021/027023, filed on Jul. 19, 2021.

(51) Int. Cl.
*B65H 1/04* (2006.01)

(52) U.S. Cl.
CPC ..... *B65H 1/04* (2013.01); *B65H 2405/114* (2013.01); *B65H 2601/272* (2013.01)

(58) Field of Classification Search
CPC ..... B65H 1/04; B65H 2405/114; B65H 2601/272
See application file for complete search history.

(56) References Cited

U.S. PATENT DOCUMENTS

| | | | | |
|---|---|---|---|---|
| 6,050,565 | A | 4/2000 | Fetherolf | |
| 6,170,817 | B1 | 1/2001 | Kawaguchi | |
| 2012/0025449 | A1* | 2/2012 | Yanagi | B65H 1/04 271/234 |
| 2018/0170695 | A1 | 6/2018 | Kitsuki et al. | |

FOREIGN PATENT DOCUMENTS

| | | | |
|---|---|---|---|
| JP | H4-286559 | A | 10/1992 |
| JP | H10-231028 | A | 9/1998 |
| JP | H10-265062 | A | 10/1998 |
| JP | H11-334889 | A | 12/1999 |
| JP | 2002-255357 | A | 9/2002 |
| JP | 2002284362 | A * | 10/2002 |
| JP | 2012-30960 | A | 2/2012 |

(Continued)

OTHER PUBLICATIONS

Machine translation JP2015187028A (Year: 2015).*

(Continued)

*Primary Examiner* — Scott A Browne
*Assistant Examiner* — Lidia Kwiatkowska
(74) *Attorney, Agent, or Firm* — WOMBLE BOND DICKINSON US LLP

(57) ABSTRACT

A medium conveying apparatus includes a mounting table having a mounting surface on which a medium is to be placed, a side guide disposed on the mounting surface and including a restricting surface to restrict the medium in a width direction of the medium, and a recessed portion disposed at an upstream or downstream end portion of the side guide in a medium conveyance direction of the medium. The recessed portion has an upper surface and a side surface. The side surface includes a first portion having a first angle with respect to the restricting surface and a second portion having a second angle with respect to the restricting surface. The second angle is different from the first angle.

6 Claims, 15 Drawing Sheets

(56) References Cited

FOREIGN PATENT DOCUMENTS

| | | | | |
|---|---|---|---|---|
| JP | 2015187028 | A | * | 10/2015 |
| JP | 2017105577 | A | * | 6/2017 |
| JP | 2018-100174 | A | | 6/2018 |
| KR | 10-0976567 | B1 | | 8/2010 |

OTHER PUBLICATIONS

Machine translation JP2017105577A (Year: 2017).*
Machine translation JP2002284362A (Year: 2002).*
Search Report dated Sep. 21, 2021 for corresponding Japanese Application No. PCT/JP2021/027023 (4 pages) with English Translation (3 pages).
Written Opinion dated Sep. 21, 2021 for corresponding Japanese Application No. PCT/JP2021/027023 (4 pages) with English Translation (4 pages).
International Preliminary Report on Patentability dated Jan. 18, 2024 for corresponding Japanese Application No. PCT/JP2021/027023 (5 pages) with English Translation (5 pages).
Japanese Office Action dated Aug. 20, 2024 regarding Japanese Patent Application No. 2023-536242 corresponding to U.S. Appl. No. 18/412,213 ( 3 pages) with English Translation (5 pages).
Japanese Office Action dated Jan. 20, 2026 for corresponding Japanese Patent Application No. 2025-021837 (2 pages) with English Translation (4 pages).

* cited by examiner

MEDIUM CONVEYING APPARATUS

CROSS-REFERENCE TO RELATED APPLICATIONS

This patent application is a continuation application of International Application No. PCT/JP2021/027023, having an international filing date of Jul. 19, 2021, the entire disclosure of which is hereby incorporated by reference herein.

BACKGROUND

Technical Field

The present disclosure relates to a medium conveying apparatus, and particularly relates to a medium conveying apparatus in which a side guide that restricts a medium in the width direction of the medium is disposed on a mounting table.

Related Art

Generally, in a medium conveying apparatus such as a scanner that conveys a medium to capture an image of the medium, a side guide that restricts the medium in the width direction of the medium is disposed on a mounting table for preventing the occurrence of skew in which the medium is obliquely conveyed. However, even when the medium is restricted in the width direction by the side guide, the medium may be skewed due to slipping between the medium and a roller conveying the medium. If the medium is skewed, the skewed medium may rise over the side guide, causing a medium jam.

For example, a sheet feeding apparatus includes a side guide that contacts a side surface of a bundle of sheets in the width direction of the bundle of sheets to restrict the position of the bundle of sheets in the width direction. An inner wall surface of the side guide includes a restricting portion of a recessed shape and is located outside the edges of the sheet in the width direction. The restricting portion extends in parallel to a direction in which the sheet extends in a sheet feeding direction.

A medium feeding apparatus includes a pair of edge guides that are disposed on a medium mounting portion and include guide surfaces that guide side edges of a medium in a width direction intersecting with a feeding direction of the medium. The medium feeding apparatus further includes a sheet number restricting portion disposed at an interval from a mounting surface and including a restricting surface that extends from the guide surfaces of the pair of edge guides in a direction intersecting the guide surfaces and restricts the number of media placed on the medium mounting portion.

SUMMARY

According to an embodiment of the present disclosure, a medium conveying apparatus includes a mounting table, a side guide, and a recessed portion. The mounting table has a mounting surface on which a medium is to be placed. The side guide is disposed on the mounting surface and includes a restricting surface to restrict the medium in a width direction of the medium. The recessed portion is disposed at an upstream or downstream end portion of the side guide in a medium conveyance direction of the medium. The recessed portion has an upper surface and a side surface. The side surface includes a first portion and a second portion. The first portion has a first angle with respect to the restricting surface. The second portion has a second angle with respect to the restricting surface. The second angle is different from the first angle.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
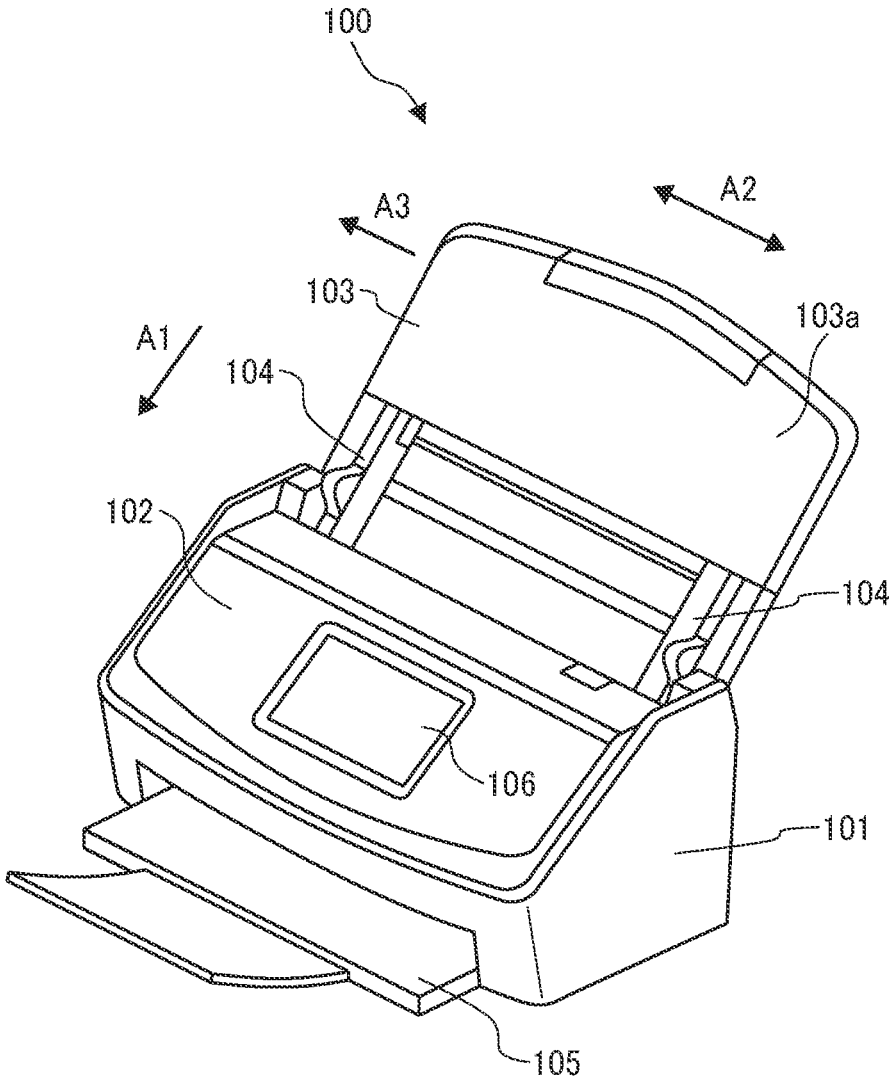
FIG. 1 is a perspective view of a medium conveying apparatus according to an embodiment of the present disclosure.

The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Below, a medium conveying apparatus, a control method, and a control program according to some aspects of the present disclosure will be described with reference to the drawings. However, it should be noted that the technical scope of the present disclosure is not limited to those embodiments, but also includes the invention described in the claims and equivalents thereof.

Figure 2:
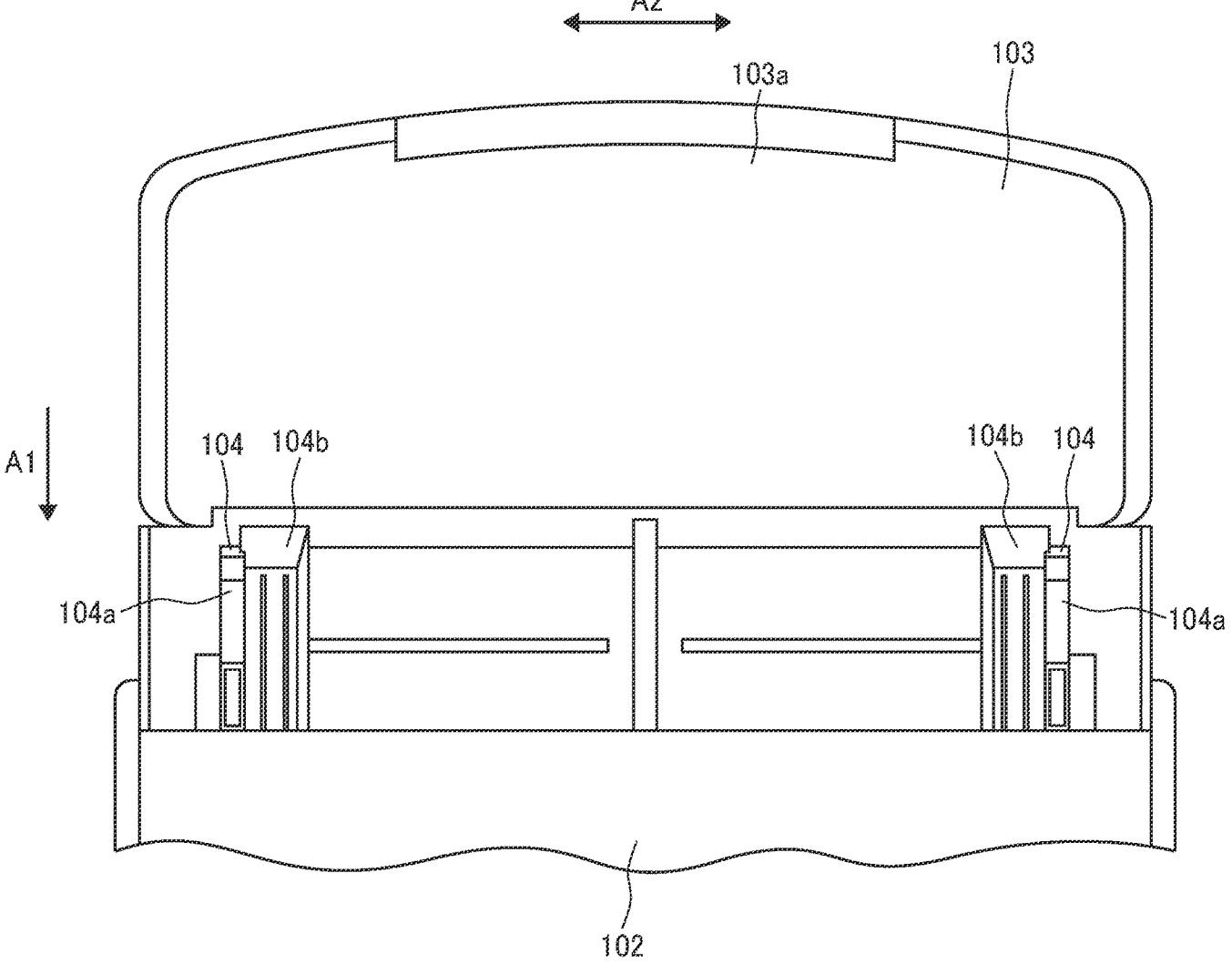
FIG. 2 is a schematic view of the periphery of side guides viewed from above, according to an embodiment of the present disclosure.

FIG. 1 is a perspective view of a medium conveying apparatus 100 constituted as an image scanner. The medium conveying apparatus 100 conveys a medium, which is a document, and captures an image of the medium. Examples of the medium include a sheet, thin paper, thick paper, a card, and a booklet. The medium conveying apparatus 100 may be, for example, a facsimile apparatus, a copying machine, or a printer multifunction peripheral (MFP). Note that the medium to be conveyed may be an object to be printed instead of a document, and the medium conveying apparatus 100 may be, for example, a printer. In FIG. 2, an arrow A1 indicates a medium conveyance direction, and an arrow A2 indicates a width direction perpendicular to the medium conveyance direction. In the following, the term "upstream" refers to upstream in the medium conveyance direction A1, and "downstream" refers to downstream in the medium conveyance direction A1.

The medium conveying apparatus 100 includes a lower housing 101, an upper housing 102, a mounting table 103, side guides 104, a discharge table 105, and a display operation device 106.

The upper housing 102 is disposed at a position covering an upper surface of the medium conveying apparatus 100, and is engaged with the lower housing 101 by a hinge so that the upper housing 102 can be opened and closed when a medium gets stuck or when the inside of the medium conveying apparatus 100 is cleaned.

The mounting table 103 is rotatably engaged with the lower housing 101. The mounting table 103 is arranged at a position covering the upper housing 102 and the lower housing 101 when the medium conveying apparatus 100 is not used, and functions as an exterior cover. The mounting table 103 includes a mounting surface 103*a* onto which a medium is placed, and when the medium conveying apparatus 100 is used, a medium to be conveyed is placed on the mounting table 103. In FIG. 1, an arrow A3 indicates a height direction perpendicular to the mounting surface 103*a*.

The side guides 104 are disposed on the mounting surface 103*a* of the mounting table 103 to be movable in the width direction A2 perpendicular to the medium conveyance direction. The side guides 104 are positioned in accordance with the width of the medium placed on the mounting table 103, and restrict the width direction of the medium. In the example illustrated in FIG. 1, two side guides 104 are arranged with an interval in the width direction A2. However, only one side guide 104 may be provided.

The discharge table 105 is housed inside the lower housing 101 and can be pulled out from the lower housing 101. When the discharge table 105 is pulled out, the discharge table 105 holds a discharged medium. Note that the discharge table 105 may be engaged with the upper housing 102.

The display operation device 106 includes a display and an interface circuit. The display includes, for example, a liquid crystal and an organic Electro-Luminescence (EL) display. The interface circuit outputs image data to the display, and the image data is displayed on the display. The display operation device 106 further includes an input device of a touch panel type and an interface circuit that acquires a signal from the input device. The display operation device 106 receives an operation by a user, and outputs an operation signal in accordance with the input by the user. Note that a display device and an operating device may be provided separately.

FIG. 2 is a schematic view of the periphery of the side guides 104 viewed from above.

As illustrated in FIG. 2, each of the side guides 104 includes a restricting portion 104*a* and a support portion 104*b*. The restricting portion 104*a* abuts against an end of a medium in the width direction of the medium placed on the mounting table 103, and restricts the width direction of the medium. The support portion 104*b* is disposed inside from the restricting portion 104*a* in the width direction A2, supports a lower surface of the medium placed on the mounting table 103, and guides the end of the medium in the width direction to the restricting portion 104*a*. The support portion 104*b* prevents the medium from entering between the restricting portion 104*a* and the mounting table 103. The restricting portion 104*a* and the support portion 104*b* are formed as an integral member. Note that the restricting portion 104*a* and the support portion 104*b* may be formed of separate members.

Figure 3:
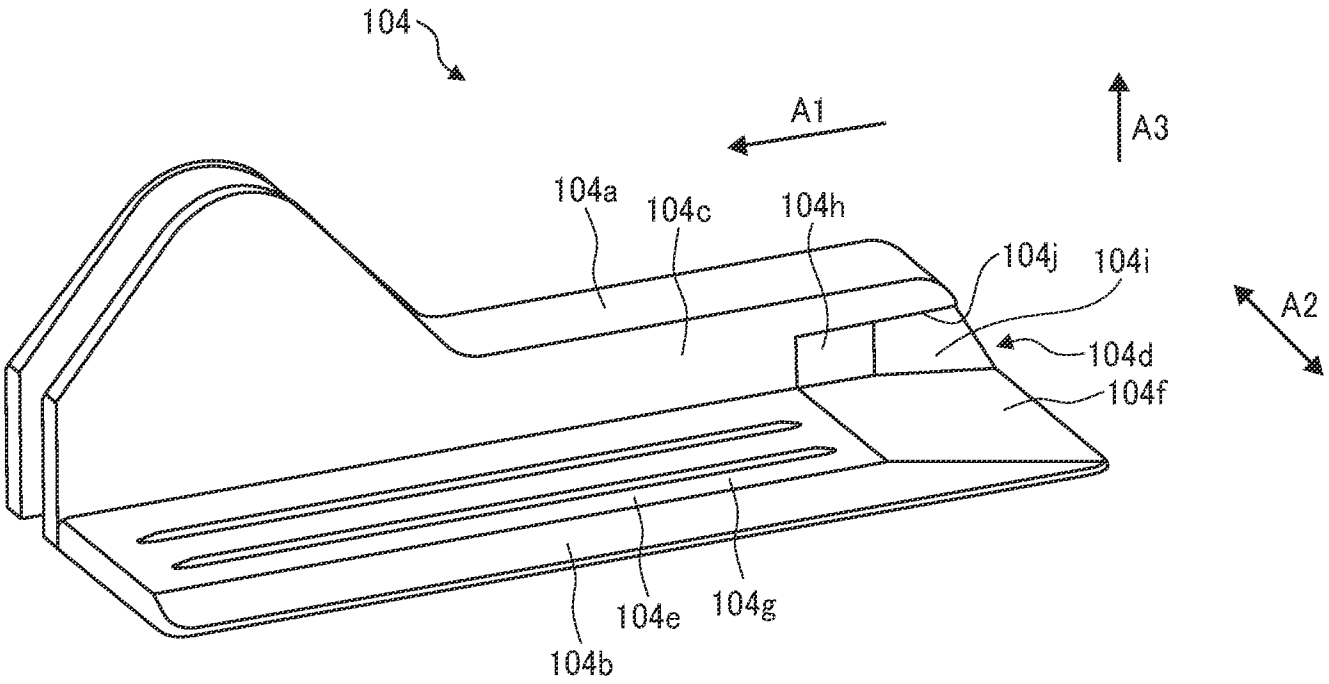
FIG. 3 is a perspective view of a side guide according to an embodiment of the present disclosure.
Figure 4:
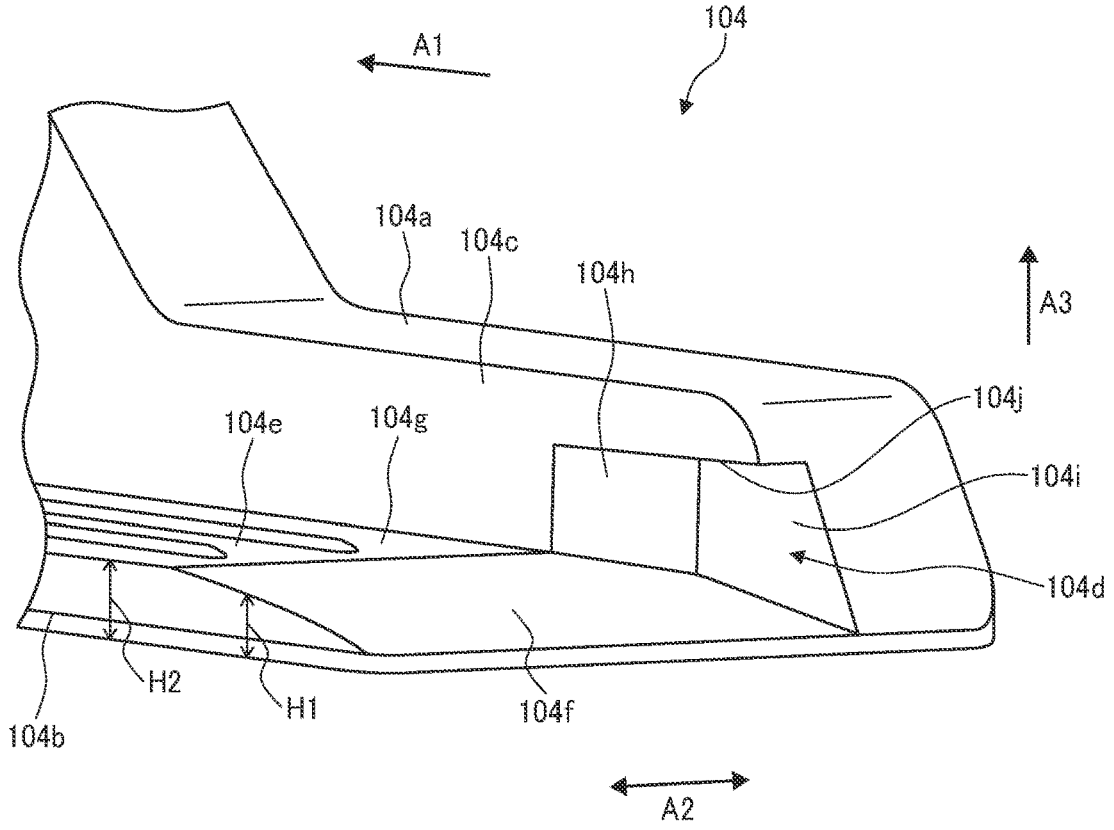
FIG. 4 is another perspective view of the side guide of FIG. 3.

FIGS. 3 and 4 are perspective views of the side guide 104 removed from the mounting table 103. FIG. 3 is a perspective view of the side guide 104 viewed from inside in the width direction A2. FIG. 4 is a perspective view of an end portion on an upstream side of the side guide 104 in the medium conveyance direction A1 viewed from the upstream side. Note that the shapes of the side guide 104 restricting a left edge of the medium and the side guide 104 restricting a right edge of the medium are symmetrical through line symmetry, and each of the side guides 104 have similar functions. Therefore, in the description below, the side guide 104 restricting the left edge of the medium will be representatively described.

As illustrated in FIGS. 3 and 4, the restricting portion 104*a* includes a restricting surface 104*c* that restricts the width direction of the medium. In the end portion on the upstream side of the side guide 104 in the medium conveyance direction A1, a recessed portion 104*d* is formed. The recessed portion 104*d* is formed to open toward the upstream side in the medium conveyance direction A1 and to open toward the restricting surface 104*c* of the side guide 104 in the width direction A2. On the other hand, the recessed portion 104*d* is formed such that the upper surface of the restricting portion 104*a* does not open in the height direction A3.

For example, the length of the recessed portion 104*d* in the medium conveyance direction A1 is set to ½ or less of the entire length of the restricting surface 104*c*. Note that the length of the recessed portion 104*d* in the medium conveyance direction A1 is preferably set to ¼ or less of the entire length of the restricting surface 104*c*. For example, the length of the recessed portion 104*d* in the medium conveyance direction A1 is set to 50 mm or less. Note that the length of the recessed portion 104*d* in the medium conveyance direction A1 is preferably set to 20 mm or less.

The length of the recessed portion 104*d* in the width direction A2 is set to ¾ or less of the entire length of the restricting portion 104*a*, for example. Note that the length of the recessed portion 104*d* in the width direction A2 is preferably set to ½ or less of the entire length of the restricting portion 104*a*. For example, the length of the recessed portion 104*d* in the width direction A2 is set to 1 mm or less. Note that the length of the recessed portion 104*d* in the width direction A2 is preferably set to 0.5 mm or less.

The length of the recessed portion 104*d* in the height direction A3 is set to ¾ or less of the entire length of the restricting surface 104*c*, for example. Note that the length of the recessed portion 104*d* in the height direction A3 is preferably set to ½ or less of the entire length of the restricting surface 104*c*. The length of the recessed portion 104*d* in the height direction A3 is set to 10 mm or less, for example. Note that the length of the recessed portion 104*d* in the height direction A3 is preferably set to 5 mm or less.

The support portion 104*b* includes a contact surface 104*e* contacting the lower surface of the medium placed on the mounting table 103. The contact surface 104*e* is formed such that the height of the contact surface 104*e* in the vicinity of an end portion on the upstream side in the medium conveyance direction A1 decreases (the thickness of the support portion 104*b* decreases) toward the end portion. In particular, the contact surface 104*e* is formed such that a height H1 of a region 104*f* overlapping with the recessed portion 104*d* in the width direction A2 perpendicular to the medium conveyance direction is lower than a height H2 of a region 104*g* not overlapping with the recessed portion 104*d* in the width direction A2 perpendicular to the medium conveyance direction. That is, the contact surface 104*e* is formed such that the height H1 of the region 104*f* overlapping with the recessed portion 104*d* in the medium conveyance direction A1 is lower than the height H2 of the region 104*g* not overlapping with the recessed portion 104*d*.

Figure 5:
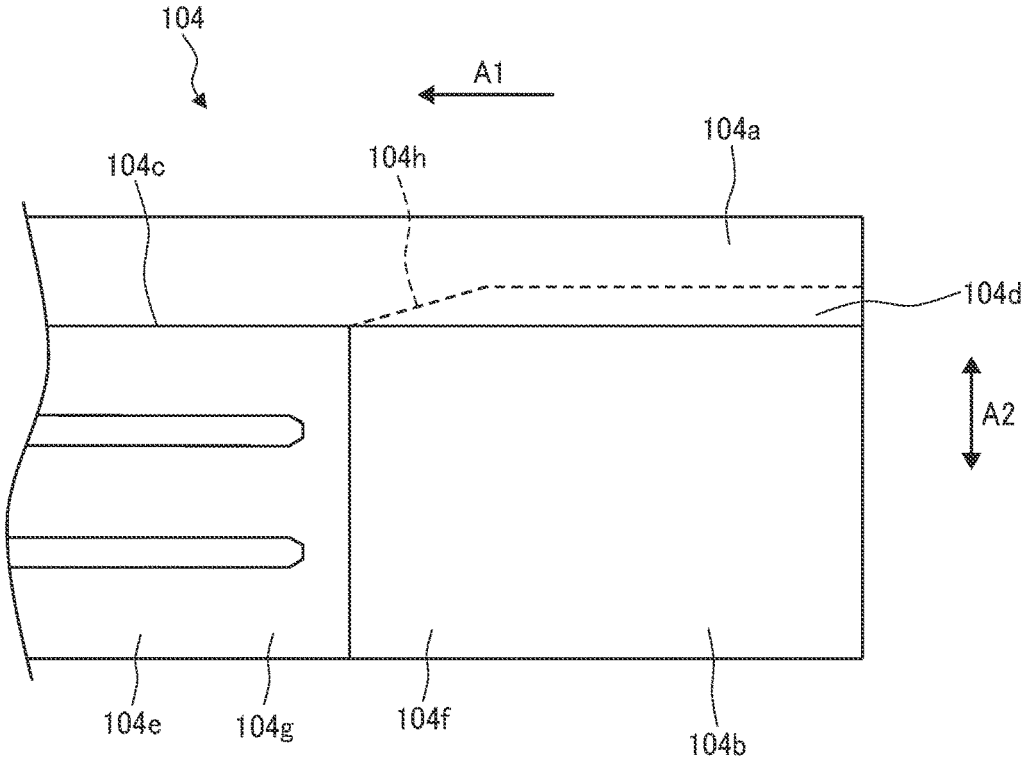
FIG. 5 is a schematic view of an end portion on an upstream side of the side guide of FIG. 3 viewed from above.

FIG. 5 is a schematic view of the end portion on the upstream side of the side guide 104 removed from the mounting table 103, viewed from above.

As illustrated in FIG. 5, an end portion 104*h* on a downstream side of the recessed portion 104*d* in the medium conveyance direction A1 is formed to be inclined with respect to the medium conveyance direction A1 and the width direction A2 perpendicular to the medium conveyance direction.

Figure 6:
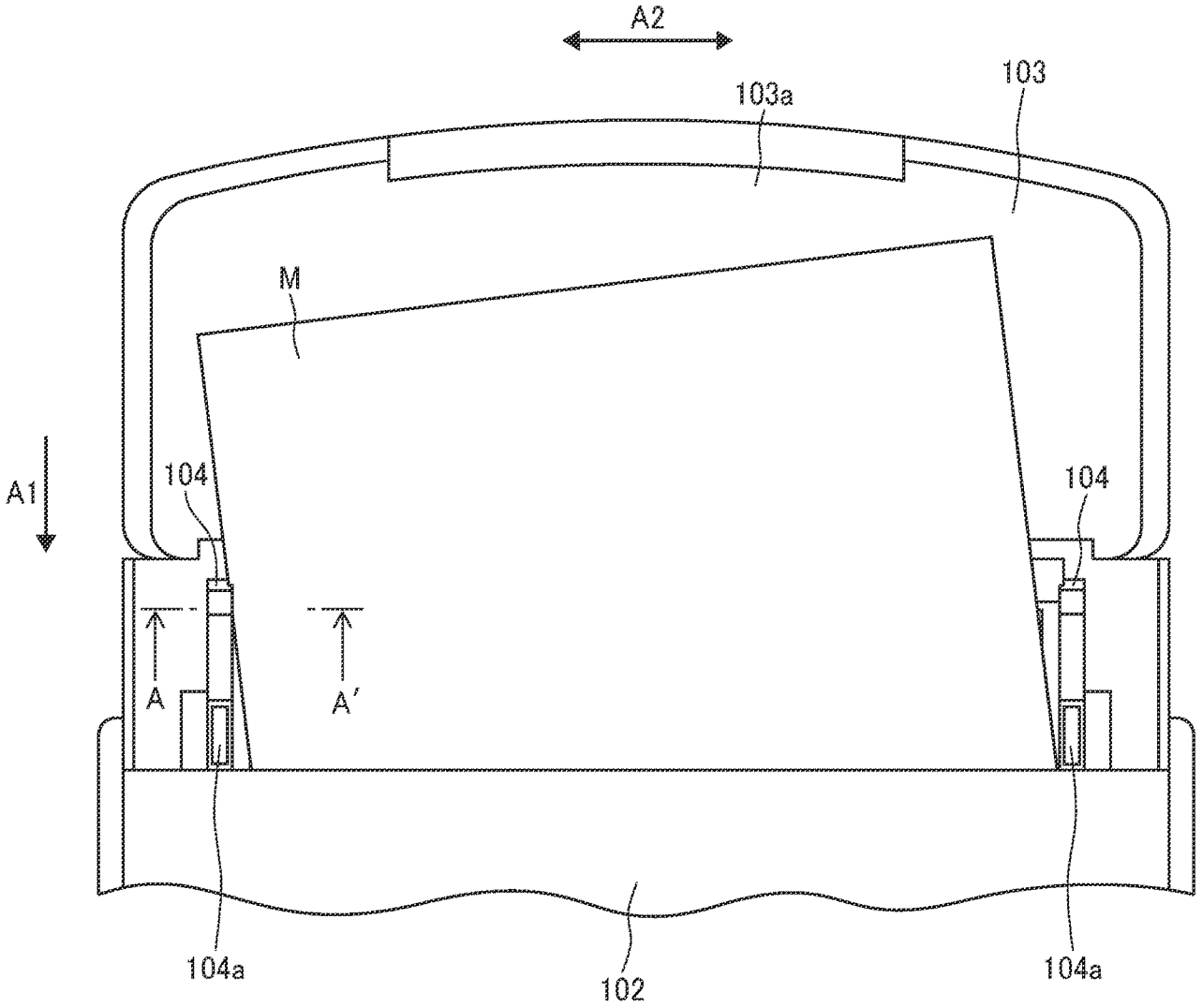
FIG. 6 is a schematic view of a medium that is obliquely conveyed.
Figure 7:
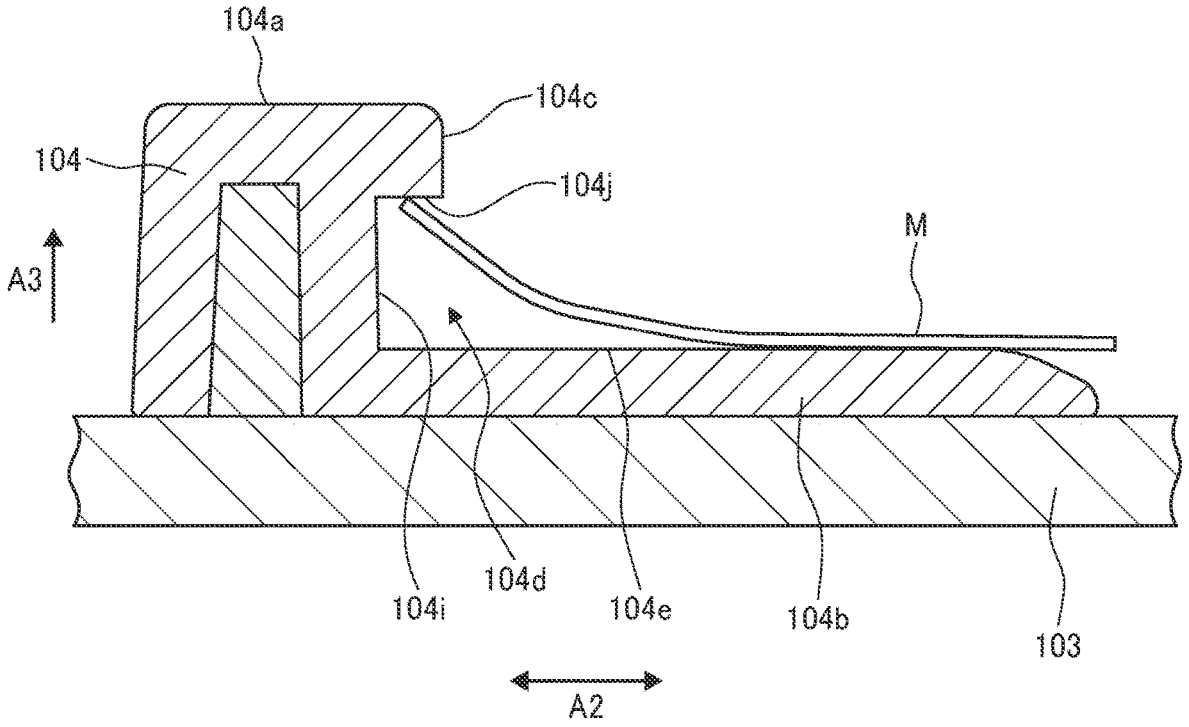
FIG. 7 is another schematic view of the medium of FIG. 6 that is obliquely conveyed.

FIGS. 6 and 7 are schematic views for explaining a medium M that is obliquely conveyed. FIG. 6 is a schematic view of a periphery of the side guides 104 viewed from above. FIG. 7 is a cross-sectional view taken along line A-A' in FIG. 6.

FIGS. 6 and 7 illustrate a state where the medium M placed on the mounting table 103 is obliquely conveyed. As illustrated in FIG. 7, the recessed portion 104*d* of the side guide 104 is formed to open toward the restricting surface 104*c*, and includes a side surface 104*i* and an upper surface 104*j* therein. As illustrated in FIG. 6, when the medium M is obliquely conveyed, the medium M rotates so that a rear end portion (an end portion on the downstream side) faces outward in the width direction A2. In the restricting surface 104*c* of the side guide 104, the recessed portion 104*d* is formed at the end portion on the upstream side in the medium conveyance direction A1, so that an end portion of the obliquely conveyed medium M at the side of the side guide 104 enters the recessed portion 104*d*. The end portion of the medium M that enters the recessed portion 104*d* collides with the side surface 104*i* formed in the recessed portion 104*d*, and rises along the side surface 104*i*. The end portion of the medium M abuts against the upper surface 104*j* formed in the recessed portion 104*d*, and the upper surface 104*j* prevents the end portion of the medium M from rising further.

As described above, the upper surface 104*j* is formed such that, when the end portion of the conveyed medium in the width direction A2 perpendicular to the medium conveyance direction enters the recessed portion 104*d*, the end portion of the medium abuts against the upper surface 104*j*. Therefore, when the medium placed on the mounting table 103 is obliquely conveyed, the end portion of the medium in the width direction A2 perpendicular to the medium conveyance direction enters the recessed portion 104*d* and the recessed portion 104*d* prevents the medium from uplifting, and thus, the recessed portion 104*d* functions as a canopy. Accordingly, the medium conveying apparatus 100 prevents the obliquely conveyed medium M from rising over the side guides 104 and lifting up, and prevents a lifted medium from entering a medium conveyance path and causing a medium jam.

In particular, the obliquely conveyed medium rotates so that the rear end side (upstream side) is directed outward in the width direction A2. Therefore, by providing the recessed portion 104*d* on the upstream side, the inclined medium enters the recessed portion 104*d* at an early stage. Thus, the medium conveying apparatus 100 suppresses an increase in the inclination of the medium immediately after the medium starts to incline, and suppresses the occurrence of skew in the medium.

The end portion of the obliquely conveyed medium M abuts against the upper surface 104*j* formed in the recessed portion 104*d*, and thus, a further increase in the inclination of the medium M is suppressed, and the occurrence of skew in the medium is suppressed. It is desirable that the length of the recessed portion 104*d* is set to a sufficiently small value in the height direction A3 such that the end portion of the medium M abuts against the upper surface 104*j* sooner. Therefore, the medium conveying apparatus 100 causes the end portion of the obliquely conveyed medium M to abut against the upper surface 104*j* at an early stage, so that the inclination of the medium is suppressed to a minimum.

On the other hand, as described above, the contact surface 104*e* of the support portion 104*b* is formed such that the height of the region 104*f* overlapping with the recessed portion 104*d* is low. Therefore, even when a medium having an upwardly curled end portion is conveyed, the end portion of the medium easily enters the recessed portion 104*d*, and the curled portion of the medium is prevented from rising over the side guides 104. Further, when a medium having low stiffness such as thin paper is conveyed, the medium exists along the contact surface 104*e*, and thus, the end portion of the medium easily enters the recessed portion 104*d*, and the end portion of the medium is prevented from rising over the side guides 104. Accordingly, the medium conveying apparatus 100 can suppress the occurrence of skew and jam of the medium, particularly when, for example, a medium having an upwardly curled end portion or a medium having weak stiffness such as thin paper is conveyed. Note that the contact surface 104*e* may be formed such that the height of the region 104*f* overlapping with the recessed portion 104*d* is the same as the height of the region 104*g* not overlapping with the recessed portion 104*d*.

Further, the recessed portion 104*d* is formed at the end portion on the upstream side in the medium conveyance direction A1, and a region of the restricting surface 104*c* downstream of the recessed portion 104*d* has a flat surface. The flat surface of the restricting surface 104*c* is longer in the medium conveyance direction A1 than the recessed portion 104*d*, and when the medium is placed on the mounting table 103, the medium is set along the flat surface of the restricting surface 104*c*. Therefore, the medium conveying apparatus 100 prevents the medium from being obliquely placed on the mounting table 103.

If the recessed portion is formed not only in the end portion, but over the entire region of the restricting surface in the medium conveyance direction A1, the medium is set along the recessed portion when being placed on the mounting table. In this case, the user performs a burdensome operation, such as temporarily expanding a set guide outward, setting the medium, and then narrowing the set guide inward to cause the medium to enter the recessed portion. On the other hand, in the medium conveying apparatus 100, the user sets the medium along the flat surface of the restricting surface 104*c*, and thus, the user can easily place the medium. Accordingly, the medium conveying apparatus 100 can improve the convenience for the user.

As described above, the end portion 104*h* of the recessed portion 104*d* on the downstream side is formed to be inclined. Therefore, the medium conveying apparatus 100 can suppress damage to the medium caused when the medium entering the recessed portion 104*d* hits the end portion 104*h*. Note that the end portion 104*h* of the recessed portion 104*d* on the downstream side may be formed not to be inclined.

Figure 8:
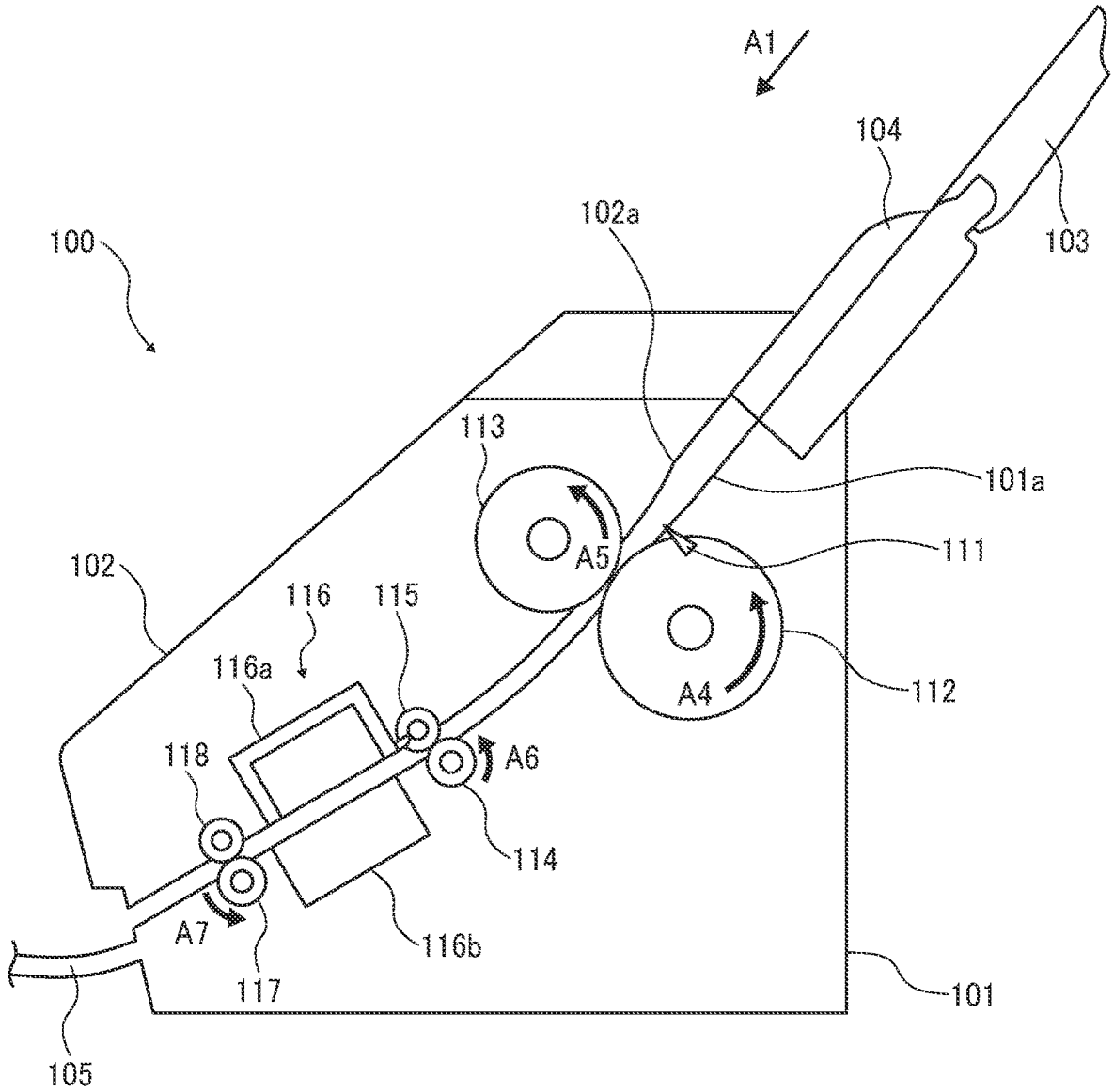
FIG. 8 is a diagram illustrating a conveyance path inside a medium conveying apparatus according to an embodiment of the present disclosure.

FIG. 8 is a diagram for explaining the conveyance path inside the medium conveying apparatus 100.

The conveyance path inside the medium conveying apparatus 100 includes a medium sensor 111, a feeding roller 112, a separation roller 113, a first conveyance roller 114, a first driven roller 115, an imaging device 116, a second conveyance roller 117, and a second driven roller 118.

Note that the number of each of the feeding roller 112, the separation roller 113, the first conveyance roller 114, the first driven roller 115, the second conveyance roller 117, and/or the second driven roller 118 is not limited to one, and a plurality of each of these components may be provided. In this case, each of the plurality of feeding rollers 112, separation rollers 113, first conveyance rollers 114, first driven rollers 115, second conveyance rollers 117, and/or second driven rollers 118 are arranged side by side with intervals in a width direction perpendicular to the medium conveyance direction A1.

An upper surface of the lower housing 101 forms a lower guide 101*a* of a conveyance path of the medium, and a lower surface of the upper housing 102 forms an upper guide 102*a* of the conveyance path of the medium.

The medium sensor 111 is arranged on an upstream side of the feeding roller 112 and the separation roller 113. The medium sensor 111 includes a contact detection sensor and detects whether a medium is placed on the mounting table 103. The medium sensor 111 generates and outputs a medium signal whose signal value changes between a state where a medium is placed on the mounting table 103 and a state where the medium is not placed on the mounting table 103. Note that the medium sensor 111 is not limited to the contact detection sensor, and any other sensor detecting whether a medium is present, such as a photodetection sensor, may be used as the medium sensor 111.

The feeding roller 112 is disposed in the lower housing 101, and sequentially separates and feeds media placed on the mounting table 103 from the bottommost medium. The separation roller 113 is a so-called brake roller or a retard roller, is disposed in the upper housing 102, is arranged facing the feeding roller 112, and rotates in the opposite direction to a medium feeding direction. Note that the feeding roller 112 may be disposed in the upper housing 102, the separation roller 113 may be disposed in the lower housing 101, and the feeding roller 112 may sequentially feed media placed on the mounting table 103 from the uppermost medium.

The imaging device 116 is arranged on a downstream side of the first conveyance roller 114 and captures an image of the medium conveyed by the first conveyance roller 114. The imaging device 116 includes a first imaging device 116*a* and a second imaging device 116*b* that are arranged to face each other with the medium conveyance path sandwiched therebetween. The first imaging device 116*a* includes a line sensor using a Contact Image Sensor (CIS) of an equal-magnification optical system type and including an imaging element using a Complementary Metal Oxide Semiconductor (CMOS) linearly arrayed in a main scanning direction. Further, the first imaging device 116*a* includes a lens that forms an image on the imaging element, and an A/D converter that amplifies an electrical signal output from the imaging element and performs analog/digital (A/D) conversion. The first imaging device 116*a* captures an image of a front surface of the medium being conveyed, generates an input image, and outputs the generated input image, in accordance with control from a processing circuit described later.

Similarly, the second imaging device 116*b* includes a line sensor using a CIS of an equal-magnification optical system type that uses imaging elements using CMOS elements linearly arranged in the main scanning direction. Further, the second imaging device 116*b* includes a lens that forms an image on the imaging element, and an A/D converter that amplifies an electrical signal output from the imaging element and performs analog/digital (A/D) conversion. The second imaging device 116*b* captures an image of a rear surface of the medium being conveyed, generates an input image, and outputs the generated input image, in accordance with control from a processing circuit described later.

Note that, in the medium conveying apparatus 100, only one of the first imaging device 116*a* and the second imaging device 116*b* may be provided to read only one side of the medium. Further, instead of the line sensor using a CIS of the equal-magnification optical system type including the imaging elements using CMOS elements, a line sensor may be utilized in which a CIS of an equal-magnification optical system type includes an imaging element using a Charge Coupled Device (CCD). Moreover, a reduction optical system type line sensor including an imaging element using a CMOS or a CCD may be utilized.

When the feeding roller 112 rotates in the direction of an arrow A4 in FIG. 2, that is, in the medium feeding direction, a medium placed on the mounting table 103 is conveyed between the lower guide 101*a* and the upper guide 102*a* in the medium conveyance direction A1. While the medium is being fed, the separation roller 113 rotates in the direction of an arrow A5, that is, in the direction opposite to the medium feeding direction. When a plurality of media are placed on the mounting table 103, only a medium contacting the feeding roller 112 among the media placed on the mounting table 103 is separated from the plurality of media by the action of the feeding roller 112 and the separation roller 113. Thus, media other than the separated media is prevented from being conveyed (double feeding is prevented).

The medium is fed between the first conveyance roller 114 and the first driven roller 115 while being guided by the lower guide 101*a* and the upper guide 102*a*. The first conveyance roller 114 rotates in the direction of an arrow A6 to feed the medium between the first imaging device 116*a* and the second imaging device 116*b*. The second conveyance roller 117 rotates in the direction of an arrow A7 to discharge the medium read by the imaging device 116 onto the discharge table 105.

Figure 9:
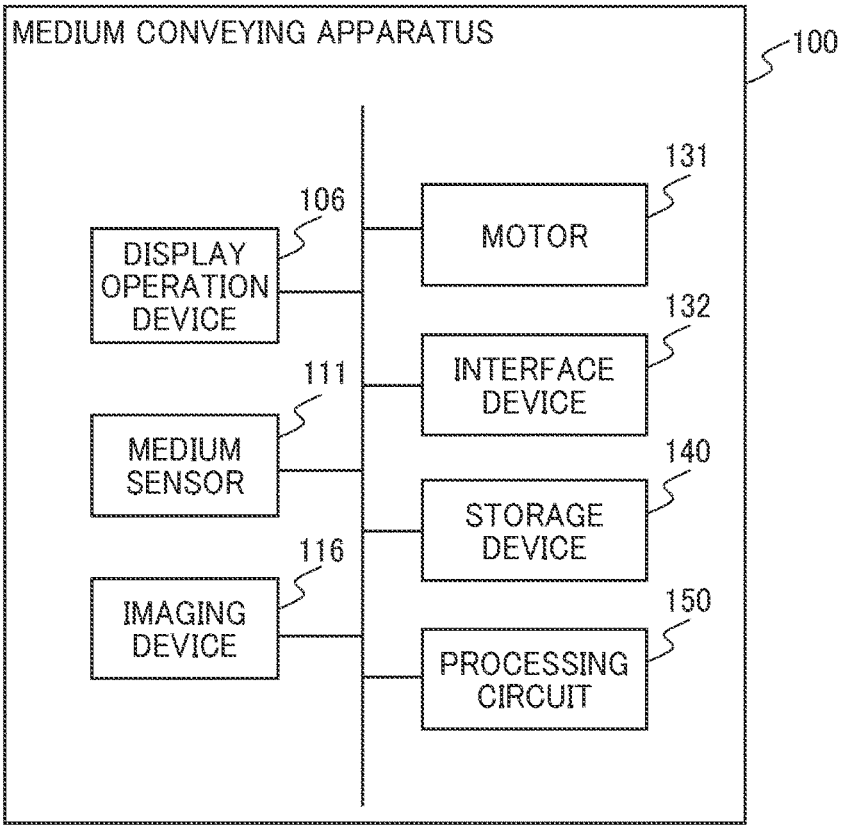
FIG. 9 is a block diagram illustrating a general configuration of a medium conveying apparatus according to an embodiment of the present disclosure.

FIG. 9 is a block diagram illustrating a general configuration of the medium conveying apparatus 100.

In addition to the above-described configuration, the medium conveying apparatus 100 further includes a motor 131, an interface device 132, a storage device 140, and a processing circuit 150.

The motor 131 includes one or more motors, and rotates, in accordance with a control signal from the processing circuit 150, the feeding roller 112, the separation roller 113, the first conveyance roller 114, and the second conveyance roller 117 to convey the medium. Note that the first driven roller 115 and/or the second driven roller 118 may be driven by the motor 131. In this case, the first conveyance roller 114 and/or the second conveyance roller 117 may be provided to rotate following the first driven roller 115 or the second driven roller 118.

The interface device 132 includes an interface circuit conforming to a serial bus such as a Universal Serial Bus (USB), and is electrically connected to an information processing device (for example, a personal computer or a mobile information terminal) to transmit and receive an input image and various types of information. Further, instead of the interface device 132, a communication unit including an antenna that transmits and receives a radio signal and a radio communication interface device for transmitting and receiving signals via a radio communication line in accordance with a predetermined communication protocol may be used. The predetermined communication protocol is, for example, a wireless Local Area Network (LAN). The communication unit may include a wired communication interface device for transmitting and receiving signals via a wired communication line in accordance with a communication protocol such as a wired LAN.

The storage device 140 includes a memory device such as a Random Access Memory (RAM) and a Read Only Memory (ROM), a fixed disk device such as a hard disk, or a portable storage device such as a flexible disk or an optical disk. The storage device 140 stores, for example, a computer program, a database, or a table used for various types of processes of the medium conveying apparatus 100. The computer program may be installed in the storage device 140 from a computer-readable portable recording medium by using, for example, a known setup program. The portable recording medium is, for example, a compact disc read only memory (CD-ROM) or a digital versatile disc read only memory (DVD-ROM).

The processing circuit 150 operates based on a program stored in the storage device 140 in advance. For example, the processing circuit is a Central Processing Unit (CPU). For example, a digital signal processor (DSP), a large scale integration (LSI), an Application Specific Integrated Circuit (ASIC), or a Field-Programmable Gate Array (FPGA) may be used as the processing circuit 150.

The processing circuit 150 is connected to, for example, the display operation device 106, the medium sensor 111, the imaging device 116, the motor 131, or the interface device 132, the storage device 140, and controls each of these components. The processing circuit 150 performs drive control of, for example, the motor 131, imaging control of the imaging device 116, based on the medium signal received from the medium sensor 111, acquires an input image from the imaging device 116, and transmits the input image to the information processing device via the interface device 132.

Figure 10:
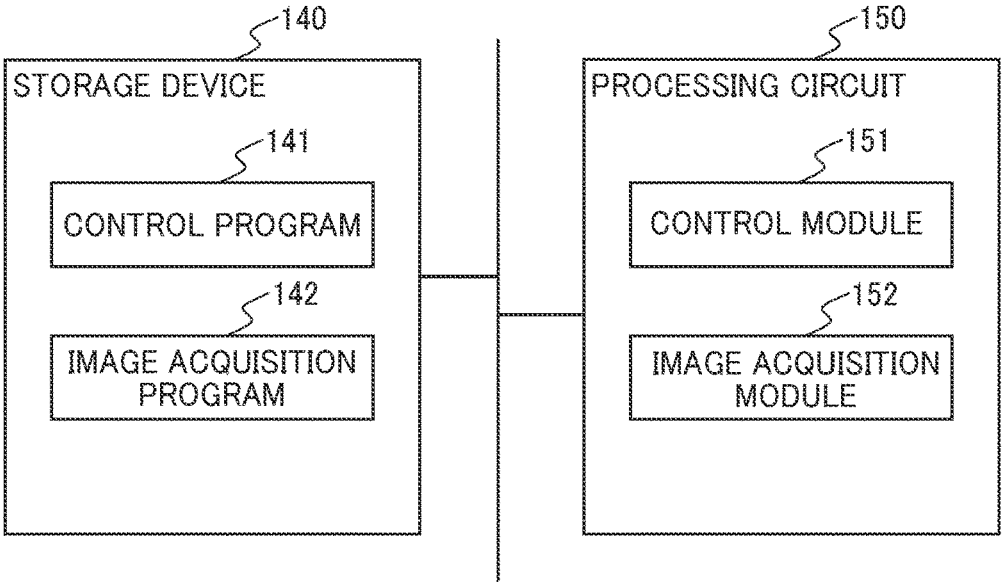
FIG. 10 is a diagram illustrating a general configuration of a storage device and a processing circuit according to an embodiment of the present disclosure.

FIG. 10 is a diagram illustrating a general configuration of the storage device 140 and the processing circuit 150.

As illustrated in FIG. 10, the storage device 140 stores, for example, a control program 141 or an image acquisition program 142. Each of these programs is a functional module implemented by software operating on a processor. The processing circuit 150 reads each program stored in the storage device 140 and operates according to each read program. Thus, the processing circuit 150 functions as a control module 151 and an image acquisition module 152.

Figure 11:
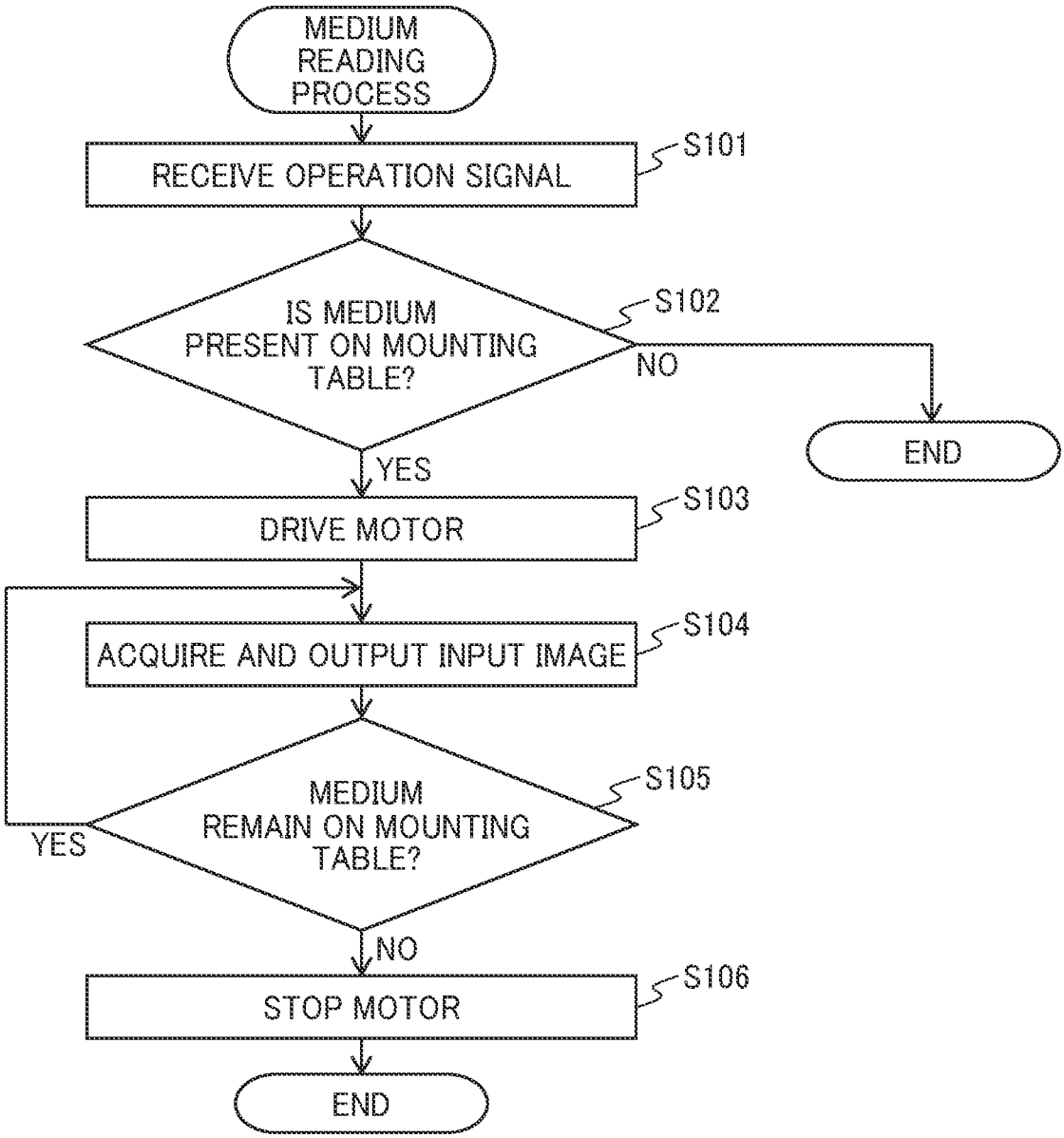
FIG. 11 is a flowchart of an operation in a medium reading process according to an embodiment of the present disclosure.

FIG. 11 is a flowchart illustrating an example of an operation in a medium reading process by the medium conveying apparatus 100.

Below, an example of the operation in the medium reading process by the medium conveying apparatus 100 will be described with reference to the flowchart illustrated in FIG. 11. The operation flow described below is mainly executed by the processing circuit 150 in cooperation with each element of the medium conveying apparatus 100, based on a program stored in the storage device 140 in advance.

First, when a user uses the display operation device 106 or the information processing device to input an instruction for reading a medium, the control module 151 waits until receiving, from the display operation device 106 or the interface device 132, an operation signal instructing to read the medium (step S101).

Next, the control module 151 acquires the medium signal from the medium sensor 111, and determines whether a medium is placed on the mounting table 103, based on the acquired medium signal (step S102). If no medium is placed on the mounting table 103, the control module 151 ends the series of steps.

On the other hand, when a medium is placed on the mounting table 103, the control module 151 drives the motor 131 to rotate the feeding roller 112, the separation roller 113, the first conveyance roller 114, and the second conveyance roller 117 and convey the medium (step S103).

Next, the control module 151 causes the imaging device 116 to capture an image of the medium, acquires an input image from the imaging device 116, and transmits the acquired input image to the information processing device via the interface device 132 to output the acquired input image (step S104).

Next, the control module 151 determines whether a medium remains on the mounting table 103, based on the medium signal received from the medium sensor 111 (step S105). If a medium remains on the mounting table 103, the control module 151 returns the processing to step S104 and repeats the processes of steps S104 and S105.

On the other hand, if no medium remains on the mounting table 103, the control module 151 controls the motor 131 to stop the feeding roller 112, the separation roller 113, the first conveyance roller 114, and the second conveyance roller 117 (step S106), and ends the series of steps.

As described in detail above, in the medium conveying apparatus 100, the recessed portion 104*d* is formed at an end portion of the side guide 104 on the upstream side to prevent the medium from uplifting when skew occurs. Therefore, the medium conveying apparatus 100 can suppress the occurrence of a medium jam while facilitating the placement of the medium on the mounting table 103 by the user.

In particular, the medium conveying apparatus 100 can suppress the occurrence of a jam of various media such as thin paper, thick paper, and wrinkled or torn sheets, and can prevent damage to the media. Moreover, the medium conveying apparatus 100 can prevent skew and jam of the medium without using special components, and thus, an increase in device cost can be suppressed.

Figure 12:
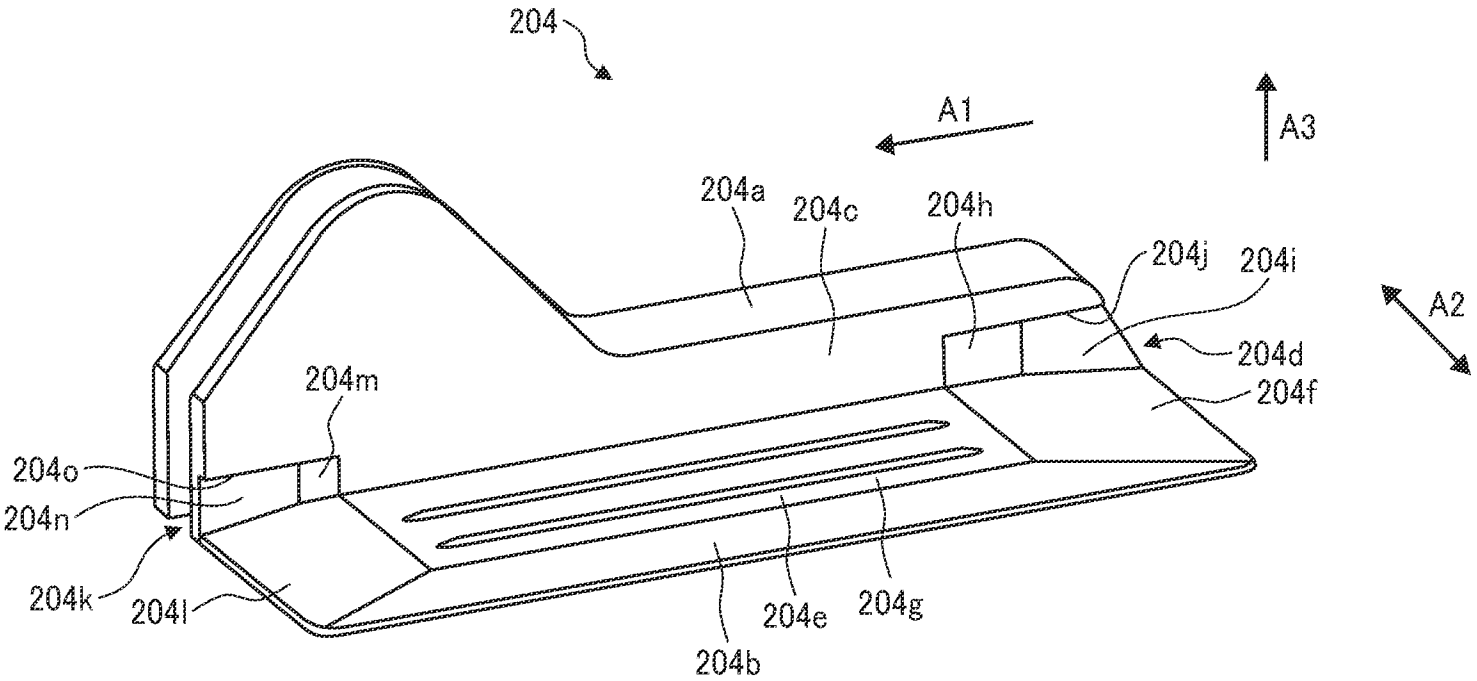
FIG. 12 is a schematic view of a side guide according to another embodiment of the present disclosure.

FIG. 12 is a schematic view for explaining another side guide 204. FIG. 12 is a perspective view of the side guide 204 removed from the mounting table 103, viewed from inside in the width direction A2.

The side guide 204 has a similar structure and function as the side guide 104, and is used instead of the side guide 104. As illustrated in FIG. 12, the side guide 204 includes a restricting portion 204*a* and a support portion 204*b* that are similar to the restricting portion 104*a* and the support portion 104*b*. The restricting portion 204*a* includes a restricting surface 204*c* that is similar to the restricting surface 104*c*. In an end portion of the side guide 204 on an upstream side in the medium conveyance direction A1, a recessed portion 204*d* that is similar to the recessed portion 104*d* is formed. Further, a second recessed portion 204*k* similar to the recessed portion 204*d* is formed at an end portion of the side guide 204 on a downstream side in the medium conveyance direction A1. The second recessed portion 204*k* is formed to open toward the downstream side in the medium conveyance direction A1 and to open toward the restricting surface 204*c* of the side guide 204 in the width direction A2. On the other hand, the second recessed portion 204*k* is formed such that the upper surface of the restricting portion 204*a* does not open in the height direction A3. The size of the second recessed portion 204*k* is set to be similar to the size of the recessed portion 204*d*.

The recessed portion 204*d* includes a side surface 204*i* and an upper surface 204*j* that are similar to the side surface 104*i* and the upper surface 104*j*. Similarly, the second recessed portion 204*k* includes a side surface 204*n* and an upper surface 204*o*. As described above, when the medium is obliquely conveyed, the medium rotates so that a rear end portion faces outward in the width direction A2. Therefore, in a medium that is slightly inclined and is restricted by the side guides 204, when the rear end of the medium passes through the side guides 204, the rear end portion rotates greatly so that the rear end portion faces outward in the width direction A2. The second recessed portion 204*k* is formed at the end portion on the downstream side of the restricting surface 204*c* of the side guide 204, so that, when the rear end of the slightly inclined medium is conveyed to a position facing the second recessed portion 204*k*, the rear end enters the second recessed portion 204*k*. The end of the medium that enters the second recessed portion 204*k* hits with the side surface 204*n* formed in the second recessed portion 204*k*, and rises along the side surface 204*n*. The end of the medium abuts against the upper surface 204*o* formed in the second recessed portion 204*k*, and the upper surface 204*o* prevents the end portion of the medium from rising further.

As described above, the upper surface 204*o* is formed such that, when the end portion of the conveyed medium in the width direction A2 perpendicular to the medium conveyance direction enters the second recessed portion 204*k*, the end portion of the medium abuts against the upper surface 204*o*. When the medium is obliquely conveyed, the inclination increases as the medium is conveyed. In particular, when a rear end (end portion on the upstream side) of the medium passes the end portion on the downstream side of the side guide 204, the medium is likely to rise over the side guides 204 and lift up. By providing the second recessed portion 204*k* at the end portion on the downstream side in the medium conveyance direction A1, the medium conveying apparatus can prevent the medium from rising over the side guides 204 and lifting up, when the rear end of the obliquely conveyed medium passes through the end portion on the downstream side of the side guides 204. Accordingly, the medium conveying apparatus can prevent an uplifted medium from entering the medium conveyance path and suppress the occurrence of a medium jam.

The second recessed portion 204*k* is formed at the end portion on the downstream side in the medium conveyance direction A1, and a central portion of the restricting surface 204*c* has a flat surface. The user can set the medium along the flat surface of the restricting surface 204*c* and can easily place the medium, so that the convenience for the user can be improved by the medium conveying apparatus.

The support portion 204*b* further includes a contact surface 204*e* that is similar to the contact surface 104*e*. The contact surface 204*e* is formed such that the height of the contact surface 204*e* in the vicinity of an end portion on the upstream side in the medium conveyance direction A1 decreases (the thickness of the support portion 204*b* decreases) toward the end portion. Similarly, the contact surface 204*e* is formed such that the height of the contact surface 204*e* in the vicinity of an end portion of the support portion 204*b* on the downstream side in the medium conveyance direction A1 decreases (the thickness of the support portion 204*b* decreases) toward the end portion. In particular, the contact surface 204*e* is formed such that the height of a region 204*f* overlapping with the recessed portion 204*d* in the width direction A2 perpendicular to the medium conveyance direction and the height of a region 2041 overlapping with the second recessed portion 204*k* in the width direction A2 perpendicular to the medium conveyance direction are lower than the height of a region 204*g* not overlapping with the recessed portion 204*d* and the second recessed portion 204*k* in the width direction A2 perpendicular to the medium conveyance direction.

Accordingly, the medium conveying apparatus can suppress the occurrence of skew in the medium and a medium jam, particularly in a case where, for example, a medium having an upwardly curled end portion or a medium having weak stiffness such as thin paper is conveyed. Note that the contact surface 204*e* may be formed such that the height of the region 204*f* overlapping with the recessed portion 204*d* and/or the height of the region 2041 overlapping with the second recessed portion 204*k* is the same as the height of the region 204*g* not overlapping with the recessed portion 204*d* and the second recessed portion 204*k*.

Similarly to the end portion 104*h* on the downstream side of the recessed portion 104*d* in the medium conveyance direction A1, an end portion 204*h* on the downstream side of the recessed portion 204*d* in the medium conveyance direction A1 is formed inclined with respect to the medium conveyance direction A1 and the width direction A2 perpendicular to the medium conveyance direction. Similarly, an end portion 204*m* on the downstream side of the second recessed portion 204*k* in the medium conveyance direction A1 is formed to be inclined with respect to the medium conveyance direction A1 and the width direction A2 perpendicular to the medium conveyance direction.

Therefore, the medium conveying apparatus can suppress damage to the medium caused when the medium entering the second recessed portion 204*k* collides with the end portion 204*m*. Note that the end portion 204*h* on the downstream side of the recessed portion 204*d* and/or the end portion 204*m* on the upstream side of the second recessed portion 204*k* may be formed not to be inclined.

The recessed portion 204*d* may be omitted and only the second recessed portion 204*k* may be formed on the side guide 204.

As described in detail above, even when the second recessed portion 204*k* is formed at the end portion on the downstream side of the side guide 204, the medium conveying apparatus can suppress the occurrence of a medium jam while facilitating the placement of the medium on the mounting table 103 by the user.

Figure 13:
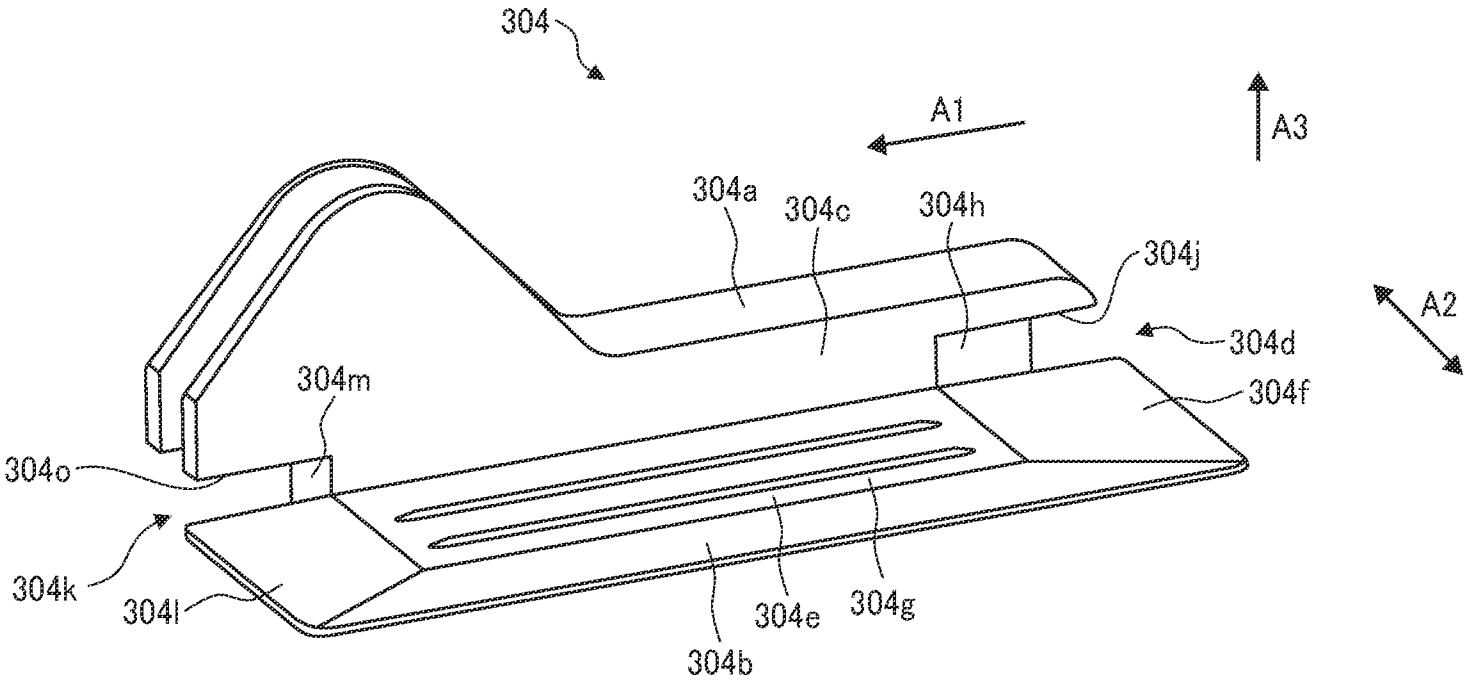
FIG. 13 is a schematic view of a side guide according to still another embodiment of the present disclosure.

FIG. 13 is a schematic view for explaining still another side guide 304. FIG. 13 is a perspective view of the side guide 304 removed from the mounting table 103, viewed from inside in the width direction A2.

The side guide 304 has a similar structure and function as the side guide 204, and is used instead of the side guide 204. As illustrated in FIG. 13, the side guide 304 includes a restricting portion 304*a* and a support portion 304*b* that are similar to the restricting portion 204*a* and the support portion 204*b*. The restricting portion 304*a* includes a restricting surface 304*c* that is similar to the restricting surface 204*c*. A recessed portion 304*d* and a second recessed portion 304*k* that are similar to the recessed portion 204*d* and the second recessed portion 204*k* are formed at end portions on the upstream side and the downstream side of the side guide 304 in the medium conveyance direction A1. The recessed portion 304*d* is formed to open toward the upstream side in the medium conveyance direction A1 and to span over both ends of the side guide 304 in the width direction A2 perpendicular to the medium conveyance direction. Similarly, the second recessed portion 304*k* is formed to open toward the downstream side in the medium conveyance direction A1 and to span over both ends of the side guide 304 in the width direction A2 perpendicular to the medium conveyance direction. The recessed portion 304*d* and the second recessed portion 304*k* are formed such that the upper surface of the restricting portion 304*a* does not open in the height direction A3.

The recessed portion 304*d* and the second recessed portion 304*k* include an upper surface 304*j* and an upper surface 304*o* that are similar to the upper surface 204*j* and the upper surface 204*o*. The upper surface 304*j* and the upper surface 304*o* are formed so that, when the end portion of the conveyed medium in the width direction A2 perpendicular to the medium conveyance direction enters the recessed portion 304*d* or the second recessed portion 304*k*, the end portion of the medium abuts against the upper surface 304*j* or the upper surface 304*o*. When the medium is obliquely conveyed, an end portion of the medium on the side of the side guide 304 enters the recessed portion 304*d* or the second recessed portion 304*k*, and the upper surface 304*j* or the upper surface 304*o* prevent the end portion of the medium entering the recessed portion 304*d* or the second recessed portion 304*k* from uplifting. Accordingly, the medium conveying apparatus can prevent an uplifted medium from entering the medium conveyance path and suppress the occurrence of a medium jam.

The recessed portion 304*d* and the second recessed portion 304*k* are formed at the end portions in the medium conveyance direction A1, and a central portion of the restricting surface 304*c* has a flat surface. The user can set the medium along the flat surface of the restricting surface 304*c* and can easily place the medium, so that the convenience for the user can be improved by the medium conveying apparatus.

The support portion 304*b* further includes a contact surface 304*e* that is similar to the contact surface 204*e*. The contact surface 304*e* is formed such that the height of a region 304*f* overlapping with the recessed portion 304*d* in the width direction A2 perpendicular to the medium conveyance direction and the height of a region 3041 overlapping with the second recessed portion 304*k* in the width direction A2 perpendicular to the medium conveyance direction are lower than the height of a region 304*g* not overlapping with the recessed portion 304*d* and the second recessed portion 304*k* in the width direction A2 perpendicular to the medium conveyance direction. Accordingly, the medium conveying apparatus can suppress the occurrence of skew in the medium and a medium jam, particularly in a case where, for example, a medium having an upwardly curled end portion or a medium having weak stiffness such as thin paper is conveyed. Note that the contact surface 304*e* may be formed such that the height of the region 304*f* overlapping with the recessed portion 304*d* and/or the height of the region 3041 overlapping with the second recessed portion 304*k* is the same as the height of the region 304*g* not overlapping with the recessed portion 304*d* and the second recessed portion 304*k*.

Similarly to the end portion 204*h* and the end portion 204*m*, an end portion 304*h* on a downstream side of the recessed portion 304*d* and an end portion 304*m* on an upstream side of the second recessed portion 304*k* are formed inclined with respect to the medium conveyance direction A1 and the width direction A2 perpendicular to the medium conveyance direction. Therefore, the medium conveying apparatus can suppress damage to the medium caused when the medium entering the recessed portion 304*d* or the second recessed portion 304*k* collides with the end portion 304*h* or the end portion 304*m*. Note that the end portion 304*h* on the downstream side of the recessed portion 304*d* and/or the end portion 304*m* on the upstream side of the second recessed portion 304*k* may be formed not to be inclined.

Any one of the recessed portion 304*d* and the second recessed portion 304*k* may be omitted, and only the other one of the recessed portion 304*d* and the second recessed portion 304*k* may be formed on the side guide 304.

As described in detail above, even when the recessed portion 304*d* or the second recessed portion 304*k* is formed to span over both ends of the side guide 304 in the width direction A2, the medium conveying apparatus can suppress the occurrence of a medium jam while facilitating the placement of the medium on the mounting table 103 by the user.

Figure 14:
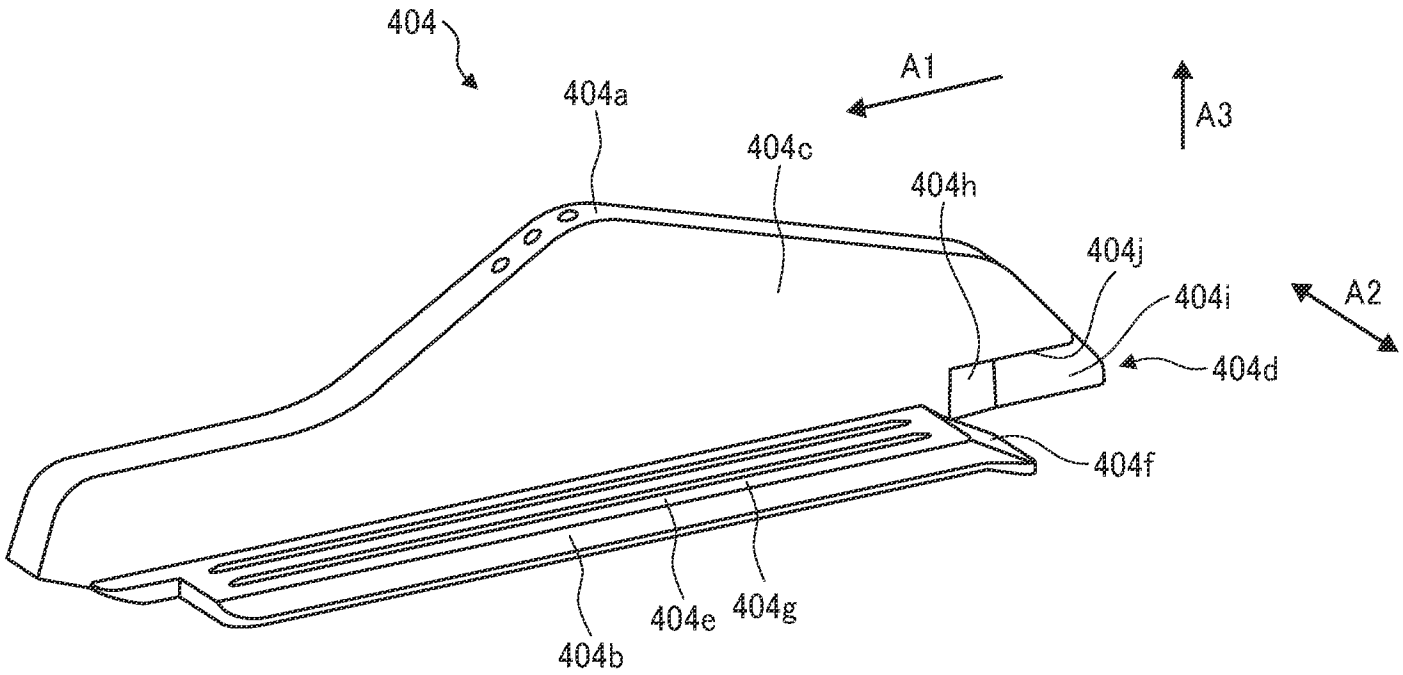
FIG. 14 is a schematic view of a side guide according to still another embodiment of the present disclosure.

FIG. 14 is a schematic view for explaining still another side guide 404. FIG. 14 is a perspective view of the side guide 404 removed from the mounting table 103, viewed from inside in the width direction A2.

The side guide 404 has a similar structure and function as the side guide 104, and is used instead of the side guide 104. As illustrated in FIG. 14, the side guide 404 includes a restricting portion 404*a* and a support portion 404*b* that are similar to the restricting portion 104*a* and the support portion 104*b*. An end portion on the upstream side of the support portion 404*b* is arranged downstream from an end portion on the upstream side of the restricting portion 404*a*.

The support portion 404*b* does not have to be arranged to face the lower housing 101 and not to face the mounting table 103.

The restricting portion 404*a* includes a restricting surface 404*c* that is similar to the restricting surface 104*c*. A recessed portion 404*d* that is similar to the recessed portion 104*d* is formed at an end portion of the side guide 404 on an upstream side in the medium conveyance direction A1. The recessed portion 404*d* includes a side surface 404*i* and an upper surface 404*j* that are similar to the side surface 104*i* and the upper surface 104*j*. Similarly to the end portion 104*h*, an end portion 404*h* on a downstream side of the recessed portion 404*d* is formed inclined with respect to the medium conveyance direction A1 and the width direction A2 perpendicular to the medium conveyance direction.

The support portion 404*b* includes a contact surface 404*e* that is similar to the contact surface 104*e*. The contact surface 404*e* is formed such that the height of a region 404*f* overlapping with the recessed portion 404*d* in the width direction A2 perpendicular to the medium conveyance direction is lower than the height of a region 404*g* not overlapping with the recessed portion 404*d* in the width direction A2 perpendicular to the medium conveyance direction.

As described in detail above, even when the end portion on the upstream side of the support portion 404*b* is arranged downstream from the end portion on the upstream side of the restricting portion 404*a*, the medium conveying apparatus can suppress the occurrence of a medium jam while facilitating the placement of the medium on the mounting table 103 by the user.

Figure 15:
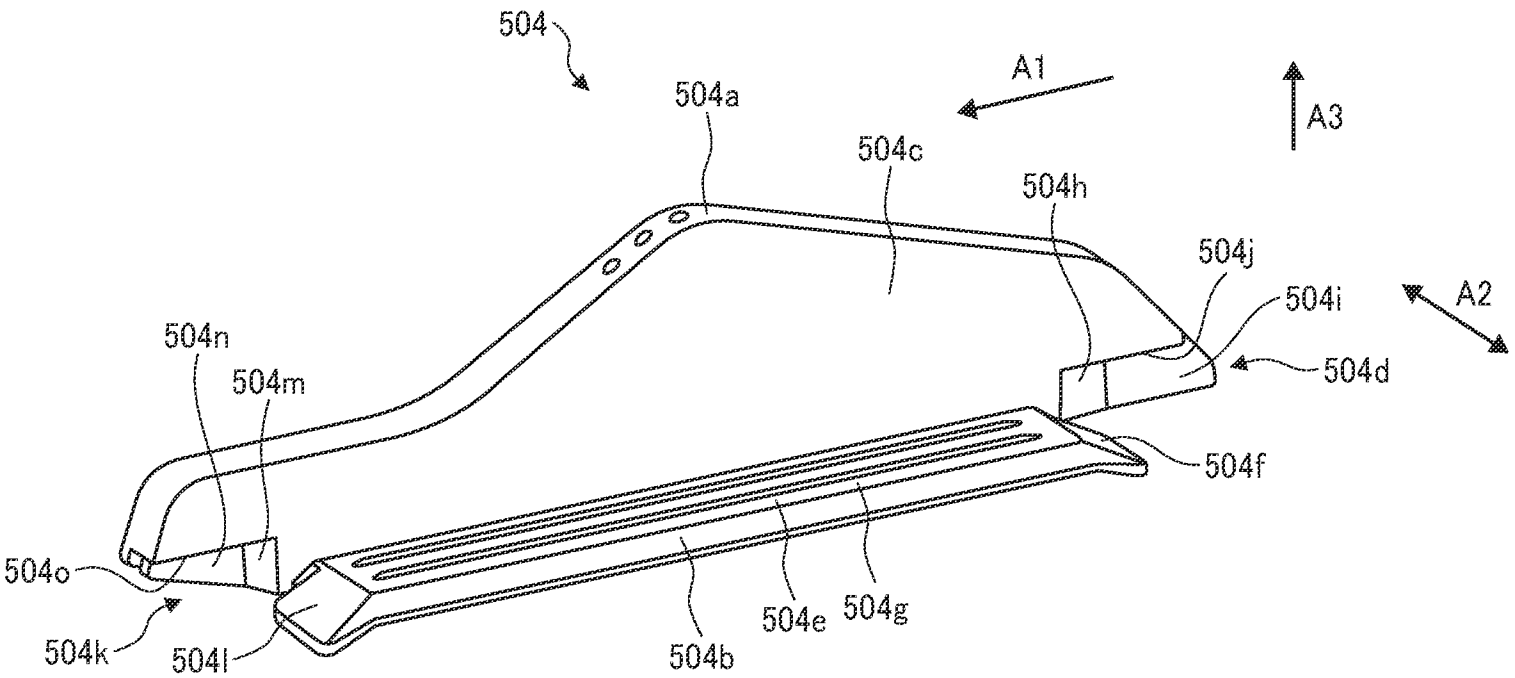
FIG. 15 is a schematic view of a side guide according to still another embodiment of the present disclosure.

FIG. 15 is a schematic view for explaining still another side guide 504. FIG. 15 is a perspective view of the side guide 504 removed from the mounting table 103, viewed from inside in the width direction A2.

The side guide 504 has a similar structure and function as the side guide 204, and is used instead of the side guide 204. As illustrated in FIG. 15, the side guide 504 includes a restricting portion 504*a* and a support portion 504*b* that are similar to the restricting portion 204*a* and the support portion 204*b*. However, an end portion on the upstream side of the support portion 504*b* is arranged downstream from an end portion on the upstream side of the restricting portion 504*a*, and an end portion on the downstream side of the support portion 504*b* is arranged upstream from an end portion on the downstream side of the restricting portion 504*a*. The support portion 504*b* does not have to be arranged to face the lower housing 101 and not to face the mounting table 103.

The restricting portion 504*a* includes a restricting surface 504*c* that is similar to the restricting surface 204*c*. A recessed portion 504*d* and a second recessed portion 504*k* that are similar to the recessed portion 204*d* and the second recessed portion 204*k* are formed at end portions of the side guide 504 in the medium conveyance direction A1. The recessed portion 504*d* includes a side surface 504*i* and an upper surface 504*j* that are similar to the side surface 204*i* and the upper surface 204*j*. The second recessed portion 504*k* includes a side surface 504*n* and an upper surface 504*o* that are similar to the side surface 204*n* and the upper surface 204*o*. Similarly to the end portion 204*h* and the end portion 204*m*, an end portion 504*h* on a downstream side of the recessed portion 504*d* and an end portion 504*m* on an upstream side of the second recessed portion 504*k* are formed inclined with respect to the medium conveyance direction A1 and the width direction A2 perpendicular to the medium conveyance direction.

The support portion 504*b* includes a contact surface 504*e* that is similar to the contact surface 204*e*. The contact surface 504*e* is formed such that the height of a region 504*f* overlapping with the recessed portion 504*d* in the width direction A2 perpendicular to the medium conveyance direction and the height of a region 504*l* overlapping with the second recessed portion 504*k* in the width direction A2 perpendicular to the medium conveyance direction are lower than the height of a region 504*g* not overlapping with the recessed portion 504*d* and the second recessed portion 504*k* in the width direction A2 perpendicular to the medium conveyance direction.

The recessed portion 504*d* may be omitted and only the second recessed portion 504*k* may be formed on the side guide 504.

As described in detail above, even when the end portion of the support portion 504*b* is arranged more to the center side than the end portion of the restricting portion 504*a*, the medium conveying apparatus can suppress the occurrence of a medium jam while facilitating the placement of the medium on the mounting table 103 by the user.

Figure 16:
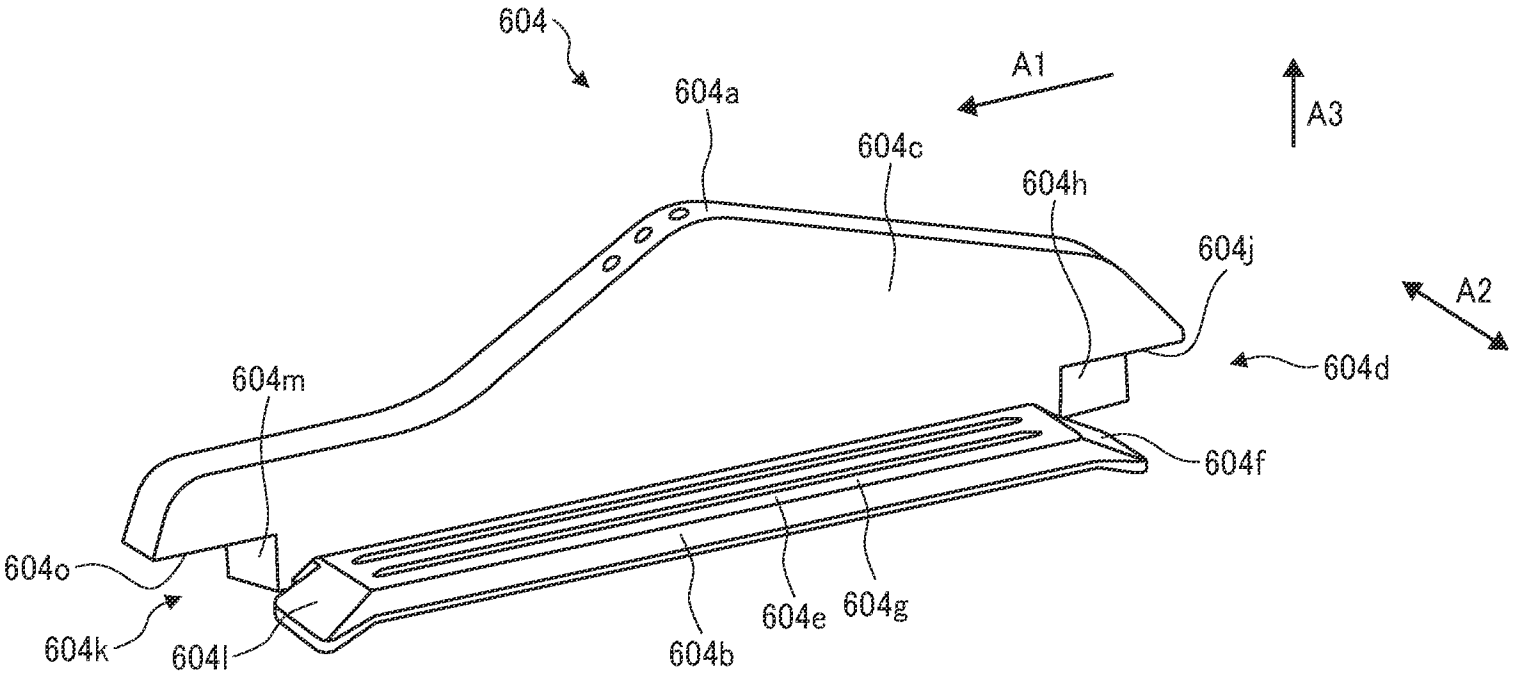
FIG. 16 is a schematic view of a side guide according to still another embodiment of the present disclosure.

FIG. 16 is a schematic view for explaining still another side guide 604. FIG. 16 is a perspective view of the side guide 604 removed from the mounting table 103, viewed from inside in the width direction A2.

The side guide 604 has a similar structure and function as the side guide 304, and is used instead of the side guide 304. As illustrated in FIG. 16, the side guide 604 includes a restricting portion 604*a* and a support portion 604*b* that are similar to the restricting portion 304*a* and the support portion 304*b*. However, an end portion on the upstream side of the support portion 604*b* is arranged downstream from an end portion on the upstream side of the restricting portion 604*a*, and an end portion on the downstream side of the support portion 604*b* is arranged upstream from an end portion on the downstream side of the restricting portion 604*a*. The support portion 604*b* does not have to be arranged to face the lower housing 101 and not to face the mounting table 103.

The restricting portion 604*a* includes a restricting surface 604*c* that is similar to the restricting surface 304*c*. A recessed portion 604*d* and a second recessed portion 604*k* that are similar to the recessed portion 304*d* and the second recessed portion 304*k* are formed at end portions of the side guide 604 in the medium conveyance direction A1. The recessed portion 604*d* includes an upper surface 604*j* that is similar to the upper surface 304*j*. The second recessed portion 604*k* includes an upper surface 604*o* that is similar to the upper surface 304*o*. Similarly to the end portion 304*h* and the end portion 304*m*, an end portion 604*h* on a downstream side of the recessed portion 604*d* and an end portion 604*m* on an upstream side of the second recessed portion 604*k* are formed inclined with respect to the medium conveyance direction A1 and the width direction A2 perpendicular to the medium conveyance direction.

The support portion 604*b* includes a contact surface 604*e* that is similar to the contact surface 304*e*. The contact surface 604*e* is formed such that the height of a region 604*f* overlapping with the recessed portion 604*d* in the width direction A2 perpendicular to the medium conveyance direction and the height of a region 6041 overlapping with the second recessed portion 604*k* in the width direction A2 perpendicular to the medium conveyance direction are lower than the height of a region 604*g* not overlapping with the recessed portion 604*d* and the second recessed portion 604*k* in the width direction A2 perpendicular to the medium conveyance direction.

Any one of the recessed portion 604*d* and the second recessed portion 604*k* may be omitted, and only the other one of the recessed portion 604*d* and the second recessed portion 604*k* may be formed on the side guide 604.

As described in detail above, even when the end portion of the support portion 604*b* is arranged more to the center side than the end portion of the restricting portion 604*a*, the medium conveying apparatus can suppress the occurrence of a medium jam while facilitating the placement of the medium on the mounting table 103 by the user.

Figure 17:
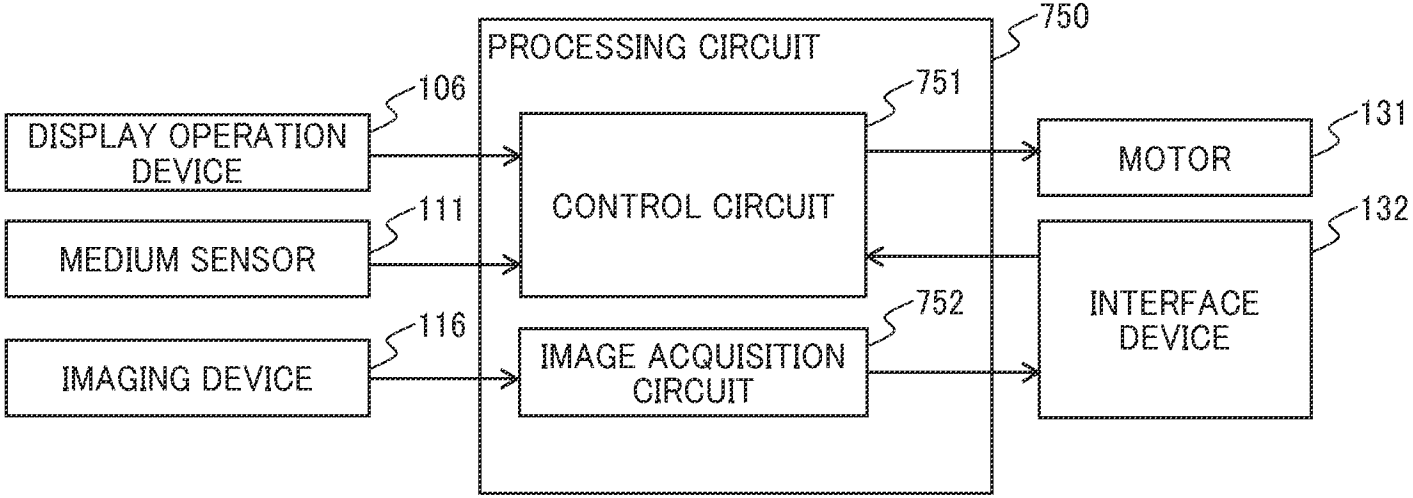
FIG. 17 is a diagram illustrating a general configuration of a processing circuit according to an embodiment of the present disclosure.

FIG. 17 is a diagram illustrating a general configuration of a processing circuit 750 in a medium conveying apparatus according to still another embodiment. The processing circuit 750 is used instead of the processing circuit 150 of the medium conveying apparatus 100 and executes, for example, a medium reading process in place of the processing circuit 150. The processing circuit 750 includes, for example, a control circuit 751 and an image acquisition circuit 752. Note that each of these components may be formed by, for example, an independent integrated circuit, a microprocessor, or firmware.

The control circuit 751 is an example of a control module and has a function similar to the control module 151. The control circuit 751 receives an operation signal from the display operation device 106 or the interface device 132 and a medium signal from the medium sensor 111. The control circuit 751 controls the motor 131, based on the received pieces of information.

The image acquisition circuit 752 is an example of an image acquisition module and has a function similar to the image acquisition module 152. The image acquisition circuit 752 acquires an input image from the imaging device 116 and outputs the acquired input image to the interface device 132.

As described in detail above, even when the processing circuit 750 is used, the medium conveying apparatus can suppress the occurrence of a medium jam while facilitating the placement of the medium on the mounting table 103 by the user.

An object and advantages of the present embodiment are understood and obtained by using the constitution components and combinations described in the claims. Both the foregoing general description and the subsequent detailed description are intended to be exemplary and explanatory and are not intended to limit the present embodiment described in the claims.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A medium conveying apparatus, comprising:

a mounting table having a mounting surface on which a medium is to be placed;

a side guide disposed on the mounting surface and including a restricting surface to restrict the medium in a width direction of the medium; and a recessed portion disposed at an upstream or downstream end portion of the side guide in a medium conveyance direction of the medium, wherein the recessed portion has a side surface including a first portion having a first angle with respect to the restricting surface and a second portion having a second angle with respect to the restricting surface, and an upper surface disposed above the side surface, and the second angle is different from the first angle, and wherein the upper surface does not protrude toward a center side of the mounting table further than the restricting surface, in a direction perpendicular to the medium conveyance direction.

2. The medium conveying apparatus according to claim 1, wherein the side guide further has a contact surface to contact a lower surface of the medium placed on the mounting table, the contact surface has a region overlapping with the recessed portion in the direction perpendicular to the medium conveyance direction and a region not overlapping with the recessed portion in the direction perpendicular to the medium conveyance direction, and the region overlapping with the recessed portion has a height lower than a height of the region not overlapping with the recessed portion.

3. The medium conveying apparatus according to claim 1, wherein an end of the recessed portion in the medium conveyance direction is inclined with respect to the direction perpendicular to the medium conveyance direction.

4. The medium conveying apparatus according to claim 1, wherein the recessed portion is open toward a side of the restricting surface of the side guide for restricting the medium in the width direction of the medium.

5. The medium conveying apparatus according to claim 1, wherein the upper surface abuts against an end of the medium when the medium is conveyed and the end of the medium in the direction perpendicular to the medium conveyance direction enters the recessed portion.

6. The medium conveying apparatus according to claim 1, wherein the upper surface is disposed above the mounting surface.

* * * * *